United States Patent [19]

Alfonso

[11] 4,014,551

[45] Mar. 29, 1977

[54] FORTUNE-TELLING GAME

[76] Inventor: Armando Alfonso, 417 E. 39th St., Hialeah, Fla. 33013

[22] Filed: Apr. 26, 1976

[21] Appl. No.: 679,897

[52] U.S. Cl. ..... 273/161; 273/135 R; 273/152.41

[51] Int. Cl.[2] ..... A63F 9/18

[58] Field of Search ..... 273/161, 135 R, 152.41

[56] References Cited

UNITED STATES PATENTS

| | | | |
|---|---|---|---|
| 2,034,991 | 3/1936 | Salinger | 273/152 R |
| 3,801,106 | 4/1974 | Milton | 273/161 |
| 3,970,315 | 7/1976 | Redner | 273/161 |

*Primary Examiner*—Anton O. Oechsle

[57] ABSTRACT

A fortune-telling game which includes as apparatus (a) a plurality of cards with numbers and symbols oriented in a common direction on each card, roughly corresponding to the symbols on conventional playing cards, and which cards, additionally, bear fortune-telling indicia and (b) a selection or gameboard. The indicia on each card when played in accordance with the instructions of the game result in a reading.

1 Claim, 2 Drawing Figures

FORTUNE-TELLING GAME

FIELD OF THE INVENTION

This invention is, generally, an amusement game which is based upon certain ideas which are given serious consideration by many people. The invention provides a gameboard and cards for use with the gameboard which may be used for amusement.

BACKGROUND OF THE INVENTION

In the past there have been numerous types of card games which, when used together or with other devices, are used for amusing interpretations or, as it is often termed, fortune-telling. The prior art devices differ from that of the instant invention among other things in that the card when arranged according to the game must be read on reference to a separate book or writing to interpret their meaning. This invention has as an object, therefore, the provision of a card game which may be used with the particular gameboard and which cards have interesting messages or printed words and phrases which when the cards have been arranged in a randomized pattern according to the game procedure provide a reading.

It is, accordingly, an object of this invention to provide a novel type of amusement game which may be played individually.

It is another object of this invention to provide a fortune-telling game wherein the results are based upon chance.

These and other objects will become apparent hereinafter in the light of the following description made upon reference to the drawings in which:

DESCRIPTION OF PREFERRED EMBODIMENT

Figure 1:
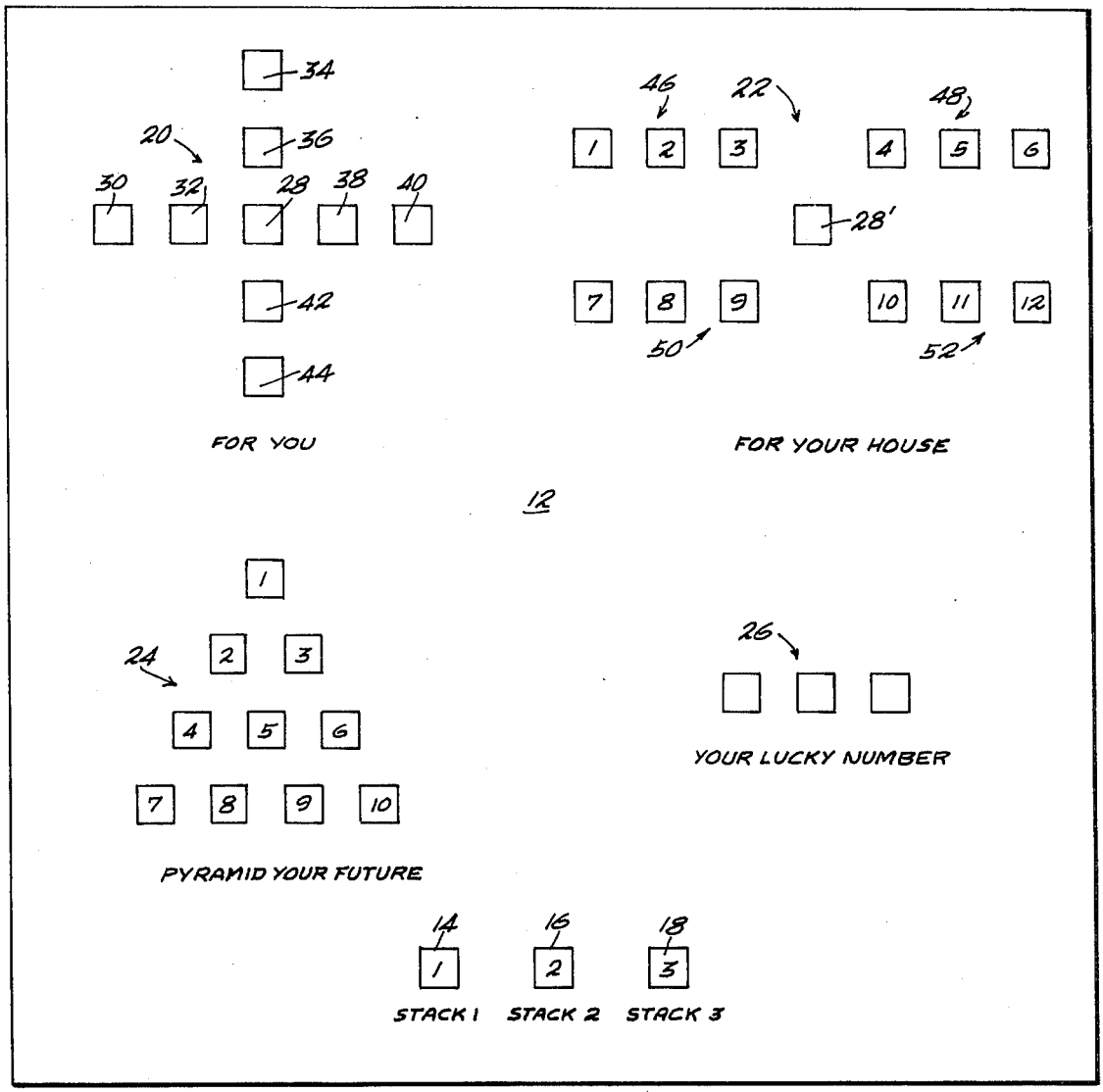
FIG. 1 is a plan view of a gameboard with indicia in accordance with this invention.

The apparatus of the instant invention preferably includes the gameboard of FIG. 1, generally designated by the numeral 12, on which indicia have been applied and which will be referred to more fully hereinafter with reference to a deck of cards, to be described more fully hereinafter.

The preferred gameboard 12 is composed of rigid material which may be folded in half, as is conventional with gameboards, such as chess or checkers. On the gameboard there is provided, preferably at the bottom, three zones 14, 16 and 18 with indicia beneath them, as follows, "stack 1," "stack 2," and "stack 3". Each of the zones is defined by an outline of an area sized similarly to that of the cards provided for use in connection with the game.

The gameboard also includes additional indicia areas 20, 22, 24 and 26 labels, respectively, "For You," "For Your House," "Pyramid Your Future," and "Your Lucky Number."

With respect to the area designated "For You," and designated by the numeral 20, there is provided a central card zone, defined by lines 28, to receive a card which is chosen according to the sex and physical characteristics of the person who is playing the game, as is described more fully hereinafter. Radiating outwardly and forming a cruciform pattern there are pairs of zones defined by lines, such as 30 and 32, 34 and 36, 38 and 40, and 42 and 44. In each of these zones a number is provided in a sequence from 1 to 8 for a purpose to be described hereinafter.

With respect to the area 22, entitled "For Your House," it includes four groups 46, 48, 50 and 52, each being of three zones defined by outlines of the cards. Each of the zones are preferably designated by numerals in a sequence 1, 2 and 3; 4, 5 and 6; 7, 8 and 9; and 10, 11 and 12. Area 22 further includes unnumbered zone 28'.

With respect to the area designated by the numeral 24 and entitled "Pyramid Your Future," there are ten card zones defined by card outlines with the zones being arranged in the form of a pyramid and each has a number in the sequence 1 through 10.

Finally, the area 26 entitled "Your Lucky Number," includes three zones each defined by an outline of a card, which zones are designated respectively by the numerals 1, 2 or 3.

Figure 2:
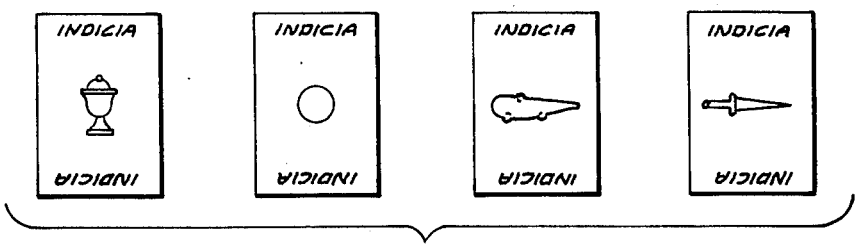
FIG. 2 is a view of representative cards for use in playing the game.

The deck of cards may be a conventional playing card deck with the exception that the individual cards bear indicia at the top and the bottom which spell out a message, as is indicated in FIG. 2. More specifically with reference to FIG. 2, there is shown a card which represents one in a conventional heart suit, another in the diamond suit, another in the club suit, and another in the spade suit. Chalices, coins, clubs and daggers, respectively, may be utilized. The deck of cards for use in playing the game consists of the king, queen or knight, jack, ace and the 2, 3, 4, 5, 6 and 7 of each suit. Thus, there is a deck of forty cards, ten in each suit.

In playing the game, first, a player selects from the deck the card which describes himself in accordance with the following:

| | | | |
|---|---|---|---|
| Brunnette Female | Blonde Female | Light Complexion Female | Grey-Haired Female |
| Jack of Clubs No. 10 | Jack of Diamonds No. 10 (with gold coins) | Jack of Hearts No. 10 (with chalice) | Jack of Spades No. 10 |
| Brunette Male | Blonde Male | Light Complexion Male | Grey-Haired Male |
| King of Clubs No. 12 | King of Diamonds No. 12 (with gold coins) | King of Hearts No. 12 (with challice) | King of Spades No. 12 |

The card selected is placed in the central zone 28 of that portion designated "For You". Thereafter, the remaining cards of the deck are separated into three roughly equal height stacks and one is placed on each of the stack defining outlines 14, 16 and 18. Thereafter, going from left to right, a car is selected from the top of each of the stacks in the order indicated, 1, 2 and 3. When a stack is exhausted, the process continues with the cards of the remaining stacks and so on until the deck is in the hands of the player. Each succeeding card selected is placed on top of the cards which are held in the player's hand. Thereafter, going from the top down, the cards are placed on the zones 32 through 44 of the area entitled "For You," that is in area 20, in the order going first to the lowest number to the highest number.

The player then reads the indicia at the top of each of the cards and this is his reading which he is able to make directly without reference to a book to interpret the cards. The same procedure is followed with respect to the area designated "For Your House," and a reading results.

With respect to the "pyramid zone" the cards are shuffled and the deck is cut in two. One of the two stacks is selected by the player; and from the selected stack cards are taken from the top and placed on the zones of area 24 in the order 1 through 10. Again the interpretation is read directly from the top of the cards.

Finally, with respect to the area designated by the numeral 26, the cards are well shuffled and divided into three stacks. These are placed, respectively, on the areas indicated by the numerals 14, 16 and 18. Thereafter, one card is taken from the top of each stack and placed in the "your lucky number" area in order 1, 2 and 3. The number which appears on the three cards determine the lucky number combination of the player.

With respect to FIG. 2, the playing cards are generally indicated. There follows a description of what appears on the cards of the deck. For example, the king of hearts, which is number 12, has indicia which reads at the top, that is when the chalices or hearts are oriented upwardly, "charitable and honorable dark-haired man, etc." If the card is oriented downwardly the indicia which appear at the top of the card will read "jealous, aggresive, dark-haired man, etc." This card also includes the luck number zero.

For the benefit of the reader, there is set forth more fully hereinafter the preferred indicia which appear on the cards of the deck. They are as follows:

HEARTS (CHALICES)

KING OF HEARTS No. 12
- Charitable and honorable dark haired man. If the Ace of Diamonds follows, you can trust the proposition he makes. (Straight up)
- Jealous, aggressive, dark-haired man filled with complexes (upside down)
- Lucky No. 0

KNIGHT OF HEARTS (on horseback) No. 11
- Endearing message either from a relative or a loved one. (Straight up)
- Bad news. You will be very disillusioned by it. If next to the Seven of Clubs, message forthcoming. (Upside down)
- Lucky No. 9

JACK OF HEARTS No. 10
- Generous, good hearted fair haired person from whom you can expect a great favor, if next to the Knight of Hearts. (Straight up)
- Delayed favors from a fair haired person. (Upside down)
- Lucky No. 8

ACE OF HEARTS No. 1
- Your house. Beside the Two of Clubs, there will be moves and changes. (Straight up)
- Home matters urgently need priority. (Upside down)
- Lucky No. 1

TWO OF HEARTS No. 2
- Affection, love, passion. If coupled with the Six of Hearts, straight up, an advantageous matrimony. (Straight up)
- Disillusionment. If coupled with the SIX of SPADES, you could be a victim of a false declaration of love. (Upside down)
- Lucky No. 2

THREE OF HEARTS No. 3
- Faith and hope. Coupled with the SIX of HEARTS, all obstacles will be overcome (straight up)
- There is a delay in money coming from business transactions. (upside down)
- Lucky No. 3

FOUR OF HEARTS No. 4
- Parties, get-togethers, social activities are in the foreground. If next to the SIX of HEARTS, a joyful wedding. (straight up)
- False friendship. If preceded by the FIVE of CLUBS, upside down, you will find out about the disloyalty of a friend.
- Lucky No. 4

FIVE OF HEARTS No. 5
- Good fortune, satisfaction, honors. Coupled with the TWO of HEARTS, an approaching marriage. (straight up)
- Prosperity and happiness through an unexpected visit of a loved one. (upside down)
- Lucky No. 5

SIX OF HEARTS No. 6
- Happiness. Coupled with the SEVEN of HEARTS, it is within your grasp. If coupled with the THREE of SPADES, a happy journey. (straight up)
- Your happiness may be threatened. Don't pay any attention to rumors. (Upside down)
- Lucky No. 6

SEVEN OF HEARTS No. 7
- Obstacles. If coupled with the SIX of DIAMONDS, straight up, these will be overcome. (straight up).
- Prosperity and happiness if coupled with the ACE of HEARTS.
- Lucky No. 7

DIAMONDS (COINS)

KING OF DIAMONDS No. 12
- A fair haired man on whom you can lean with utmost confidence. (straight up)
- A fair haired man who is dangerous but superior in love and in business. (upside down)
- Lucky No. 0

KNIGHT OF DIAMONDS (on horseback) No. 11
- Messenger with some important news from people who remember you. (straight up)
- Undesirable news which will disgust you. (upside down)
- Lucky No. 9

JACK OF DIAMONDS No. 10
- Blonde woman, very astute. (straight up)
- Blonde woman treacherous in both love and friendship. (upside down)
- Lucky No. 8

ACE OF DIAMONDS No. 1

Good fortune and success in whatever you try. (straight up)
Favorable business transaction, but there will be a delay. (upside down)
Lucky No. 1

TWO OF DIAMONDS No. 2
Anxiety, obstacles in plans. If coupled with the FOUR of DIAMONDS, you will learn of a pregnancy. (straight up)
Grief. You will hear of an injustice. (upside down)
Lucky No. 2

THREE OF DIAMONDS No. 3
A surprise and unexpected gifts. Good news from loved ones. (straight up)
A visit from a person bringing joy. (upside down)
Lucky No. 3

FOUR OF DIAMONDS No. 4
Compensations, rewards, presents, new friends. Coupled with the TWO of DIAMONDS, forthcoming birth of a child. (straight up)
Brilliant future in store. If followed by the SEVEN of DIAMONDS, straight up, you will have good prospects. (upside down)
Lucky No. 4

FIVE OF DIAMONDS No. 5
Favorable changes in your life. (straight up)
Disorders. Disagreeable gossip. (upside down)
Lucky No. 5

SIX OF DIAMONDS No. 6
Success in work. Improvements at home. (straight up)
You have many plans and projects on which you are working. They are hindered only if coupled with the KNIGHT of DIAMONDS. (upside down)
Lucky No. 6

SEVEN OF DIAMONDS No. 7
Much happiness, good fortune and well-being. (straight up)
Delay in great event. If coupled with the ACE of SPADES, you will triumph. (upside down)
Lucky No. 7

CLUBS

KING OF CLUBS No. 12
A dark man, generous, gentle, virtuous, a good advisor. (straight up)
A businessman. If the FIVE of SPADES precedes him, straight up, this man's propositions are good ones. (upside down)
Lucky No. 0

KNIGHT OF CLUBS (on horseback) No. 11
Someone is thinking about you. You will have good news from him. (straight up)
You will have news for great rejoicing.
Lucky No. 9

JACK OF CLUBS No. 10
A generous woman, a brunnette who is admired by all and loves children. (straight up)
A jealous woman capable of doing anything to attain her ends. (upside down)
Lucky No. 8

ACE OF CLUBS No. 1
Sadness, grief, illness if coupled with the FOUR of CLUBS. If coupled with the SEVEN Of DIAMONDS, ills diminish. (straight up)
If coupled with the THREE of CLUBS, obstructive omen, a fall, a tragedy, mourning. If coupled with the TEN of SPADES, you will recuperate. (upside down)
Lucky No. 1

TWO OF CLUBS No. 2
Unexpected journey. There will be many favorable changes. (straight up)
You will make new friends who will bring you fame and fortune. (upside down)
Lucky No. 2

THREE OF CLUBS No. 3
End of conflict. Favorable activity. (straight up)
Peace and harmony within the family. (upside down)
Lucky No. 3

FOUR OF CLUBS No. 4
Sorrow, uneasiness. If coupled with the ACE of CLUBS, upside down, you may become ill.
You will hear disagreeable gossip about friends.
Lucky No. 4

FIVE OF CLUBS No. 5
Difficult problems related to you work. Preceded by the FOUR of CLUBS, this will occur in the very near future. (straight up)
Argument with member of the opposite sex; if coupled with the SIX of SPADES, it will bring about bad consequences.
Lucky No. 5

SIX OF CLUBS No. 6
Proper time to effect the ideas you wish to develop. (straight up)
Confusion and doubt about something you want. If coupled with the ACE of SPADES, don't hesitate. (upside down)
Lucky No. 6

SEVEN OF CLUBS No. 7
Night is important. If coupled with the SIX of CLUBS, this means now. Next to the ACE of DIAMONDS, you will have marvelous nights. (straight up)
Indecision, vacillation. If the KNIGHT of SPADES follows, your worries will increase. (upside down)
Lucky No. 7

SPADES

KING of SPADES No. 12
Man of the law, just, noble, whom you can trust completely. (straight up)
You must make important decision regarding a legal transaction. (upside down)
Lucky No. 0

KNIGHT OF SPADES (on horseback) No. 11
Uniformed person will give you news which you must respect although against your will. (straight up)
Emotional disturbance. Ignorant people will try to make life impossible. (upside down)
Lucky No. 9

JACK OF SPADES No. 10
Strong-willed woman fights for what she wants. If coupled with the KING of SPADES, she will get her wishes. (straight up)
Devoted, virtuous woman, worthy of respect and admiration. (upside down)
Lucky No. 8

ACE OF SPADES No. 1
A delay in effecting plans. (straight up)

That which is desired will be obtained. (upside down)
Lucky No. 1

TWO OF SPADES No. 2
Legal papers, important letter, matters relating to the Law. (straight up)
Separation. Between business associates and between lovers. (upside down)
Lucky No. 2

THREE OF SPADES No. 3
Long distance journeys. Coupled with a person-card, journey will come to pass in company of others. (straight up)
Obstacles and disappointments in projected journey. If coupled with SIX of HEARTS, straight up, it may be realized. (upside down)
Lucky No. 3

FOUR OF SPADES No. 4
Closed passages, Ruin, loneliness, abandonment. (straight up)
Difficulty in whatever change you may want to make. Not the time for such change. (upside down)
Lucky No. 4

FIVE OF SPADES No. 5
Difficulty in business transactions or work. Coupled with the FIVE of DIAMONDS, favorable change. (straight up)
Anguish, discouragement. Material and spiritual losses.
Lucky No. 5

SIX OF SPADES No. 6
If coupled with THREE of HEARTS, jealousy, losses, grief are lessened. (straight up)
Bitterness, sorrow, litigations among family and friends. (upside down)
Lucky No. 6

SEVEN OF SPADES No. 7
Discord. Be extremely carefuly if you have to close important transactions. (straight up)
Distrust. Someone is trying to take advantage of your good will.
Preceded by a person-card, the person will soon be identified. (upside down)
Lucky No. 7

What is claimed is:

1. An amusement game comprising:

a gameboard having a game surface and indicia on the surface defining areas, a first area, a second area, a third area, a fourth area, and a fifth area, the fifth area being composed of three separate indicia defining rectangular zones, said first area being composed of a plurality of indicia defining rectangular zones arranged in a cross with a vertical line of five of said zones and a horizontal line of five of said zones with the middle zone of each line being common to both lines and an indicia in each of the zones of the cross except the middle zone designated by a numeral between one and eight in a predetermined order;

said second zone being composed of a plurality of indicia defining rectangular zones in a pattern composed of four groups of three zones equispaced from one another with each group being arranged in a line and with the groups radiating outwardly generally from a central zone defined by a rectangular outline and indicia on each of the zones of each of the groups designated by a numeral between one and twelve and arranged in a predetermined order;

said third area comprising ten indicia defining rectangular zones with each of the zones being arranged in a pattern defining a pyramid of zones, said pattern being composed of ten zones; and said fourth area comprising three indicia defining rectangular zones in a line, said gameboard comprising a selection board; and a plurality of forty cards of similar size, each having an upper end and a lower end and each of said cards being arranged in a deck and each of said cards displaying thereon a distinctive symbol indicia representing a suit, there being four suits, and each of said cards carrying indicia comprising a printed message at the upper end of the card and a different printed message at the lower end of the card, each of said zones being similarly sized and congruent to that of the cards of said deck, whereby when the cards are selected in a prescribed fashion, and positioned on the board, a message or reading will result when the indicia on the cards are read.

* * * * *